US006033285A

United States Patent [19]

Fine et al.

[11] Patent Number: 6,033,285

[45] Date of Patent: Mar. 7, 2000

[54] VIBRATING TOY CAR WITH SPECIAL EFFECTS

[75] Inventors: Alan Fine, Lenox, Mass.; Paul Nielsen, Saratoga Springs, N.Y.

[73] Assignee: Marvel Enterprises, Inc., New York, N.Y.

[21] Appl. No.: 09/020,325

[22] Filed: Feb. 6, 1998

[51] Int. Cl.[7] ..... A63H 11/02; A63H 17/00; A63H 29/02; A63H 30/04

[52] U.S. Cl. ..... 446/465; 446/462; 446/456; 446/3

[58] Field of Search ..... 446/465, 462, 446/463, 456, 485, 3, 437, 438, 439

[56] References Cited

U.S. PATENT DOCUMENTS

| | | | |
|---|---|---|---|
| 2,832,177 | 4/1958 | Mueller | 446/462 |
| 3,187,462 | 6/1965 | Licitis | 446/439 |
| 3,939,605 | 2/1976 | Allen | 46/204 |
| 3,953,027 | 4/1976 | Katzman et al. | 446/465 X |
| 4,083,143 | 4/1978 | Allen | 46/204 |
| 4,219,957 | 9/1980 | Kakuta | 446/3 X |
| 4,465,949 | 8/1984 | Knauff | 446/438 X |
| 4,488,375 | 12/1984 | Cheng | 446/443 |
| 4,575,357 | 3/1986 | Wakayama et al. | 446/437 |
| 4,580,994 | 4/1986 | Fauser et al. | 446/465 |
| 5,088,949 | 2/1992 | Atkinson et al. | 446/3 |
| 5,173,072 | 12/1992 | Ozawa | 446/462 |
| 5,195,920 | 3/1993 | Collier | 446/456 X |
| 5,203,559 | 4/1993 | Goldfarb | 446/465 X |
| 5,334,075 | 8/1994 | Kakizaki et al. | 446/456 X |
| 5,482,493 | 1/1996 | Rapisarda | 446/485 X |
| 5,482,494 | 1/1996 | Ishimoto | 446/456 |
| 5,713,783 | 2/1998 | Szoke et al. | 446/485 X |
| 5,720,646 | 2/1998 | Shannon et al. | 446/465 |
| 5,791,965 | 8/1998 | Kim | 446/485 X |

OTHER PUBLICATIONS

Rear and bottom box panels of Dodge Viper GTS Toy Car by Buddy L, Inc.

*Primary Examiner*—D Neal Muir
*Attorney, Agent, or Firm*—Robert F. Zielinski

[57] ABSTRACT

A toy vehicle includes a chassis and a body mounted to the chassis. An electro-mechanical vibration generator is operatively connected with the chassis. The vibration generator is preferably an electric motor having a weight attached to the shaft of the motor. A light source and a sound source are each operatively connected with the body. A propulsion mechanism is connected with the chassis. Operation of the propulsion mechanism causes the toy vehicle to move across the medium on which it rests. An electrical circuit and an electrical power source are each connected with the vibration generator, the light source, the sound source and the propulsion mechanism. The electrical circuit controls the sequence and timing of the connected components to provide at least one sequence of events. A switch is connected with the electrical circuit. Upon activation of the switch, the electrical circuit initiates the sequence of events. The electro-mechanical vibration generator may also be incorporated into a board game including a platform and a body mounted to the platform. A light source and a sound source are each operatively connected with the body. An electrical circuit and an electrical power source are each connected with the vibration generator, the light source and the sound source. The circuit controls the sequence and timing of the operation of the connected components to provide at least one sequence of events. A switch is connected with the electrical circuit. Upon activation of the switch, the electrical circuit initiates the sequence of events.

24 Claims, 7 Drawing Sheets

| CONSUMER ACTION | SOUND EFFECT | VEHICLE ACTION | SEGMENT TIME (SEC) | RUN TIME (SEC) |
|---|---|---|---|---|
| INSERT GAS CAN | FUEL SOUNDS | – | 5 | 0 – 5 |
| | TIRE RATCHET SOUNDS | – | 2 | 5 – 7 |
| REMOVE GAS CAN | MOTOR IGNITION | RUMBLE MOTOR STARTS | 1 | 0–1 |
| | IDLE SOUNDS | RUMBLE MOTOR RUNS | 7 | 1–8 |
| | PEEL OUT SOUNDS | RUMBLE MOTOR STOPS | 1 | 8–9 |
| | | WHEEL MOTOR STARTS | | |
| | ENGINE RUNNING | WHEEL MOTOR RUNS | 4 | 9–13 |
| | GEARS SHIFT | WHEEL MOTOR RUNS | 1 | 13–14 |
| | ENGINE RUNNING | WHEEL MOTOR RUNS | 3.5 | 14–17.5 |
| | BRAKE NOISES | WHEEL MOTOR STOPS | 1 | 17.5–18.5 |
| | IDLE SOUNDS | RUMBLE MOTOR RUNS | 7 | 18.5–25.5 |
| | MOTOR TURNS OFF | RUMBLE MOTOR STOPS | 1 | 25.5–26.5 |

FIG. 5

VIBRATING TOY CAR WITH SPECIAL EFFECTS

BACKGROUND OF INVENTION

This invention relates generally to children's toys and more specifically, to a child's toy which incorporates vibration with other effects, such as sound, light and propulsion. More specifically still, in one preferred embodiment the invention is directed to a toy vehicle that simulates an actual car by generating vibrations through an internal eccentrically weighted motor. Additionally, the vibrations may be synchronized with sounds, lights or propulsion to provide an additional measure of realism.

Children of all ages enjoy playing with toys and virtually all children at some time include toy cars in their play preferences. Many toy cars exist which roll forwards and backwards on wheels. These cars are powered by various means including electric and small gas powered motors, human applied external force (i.e. pushing or pulling), wound springs or by fly wheels. In such instance, such motion may be controlled directly by the operator, through interaction with the external environment (e.g. reverse after hitting a wall), by the vehicle itself or by a human operator through radio remote control.

Children also enjoy toys which have effects such as loud noises, vibratory motions or visual effects (e.g. flashing lights). Combinations of these effects increase the enjoyment of the toy. Combination of such special effects with toy cars are particularly appealing to children since the effects allow the toy car to simulate real vehicles. Synchronization of the effects is also desirable since it improves the realism and hence the play value of such toys.

A number of toy cars have been designed to exhibit some form of rocking motion. Toy cars which exhibit irregular motions. For example, U.S. Pat. No. 5,482,494 to Ishimoto provides a toy vehicle body that rocks from side to side with respect to the chassis. The rocking is accomplished through a series of connection rods and a V-shaped lever assembly that are driven by a servo motor. U.S. Pat. No. 4,575,354 to Wakayama et al. provides an "up and down" wobbling type motion that is accomplished by the use of irregular shaped wheels. When the car is in motion, the irregularly shaped wheels cause the body of the toy to wobble.

U.S. Pat. No. 4,488,375 to Cheng discloses a toy car with a body that pivots from side to side as it rolls forward. The pivoting motion is accomplished by connecting the chassis to the wheels of the toy by means of an eccentrically shaped cam.

U.S. Pat. Nos. 3,939,605 and 4,083,143 to Allen disclose means for rotating a figure attached to a vehicle (such an engine, a person or a tank turret) by attaching the figure to the shaft of the wheels to the object through means of a cam, drive belt or lobe. The object of the inventions is to rotate the attached figure. U.S. Pat. No. 5,088,949 to Atkinson et al. discloses a means for propelling a wheelless toy vehicle forward by use of eccentrically weighted flywheels driven by an electric motor. The forces generated by the flywheels are such that as they spin the cause the vehicle to lift slightly and move forward. The purpose of the invention is to provide a toy vehicle the can move over a smooth or rugged surface, or across water.

U.S. Pat. No. 4,580,994 to Fauser, et al. discloses a toy vehicle with a telescoping chassis driven be an electric motor that does "wheelies" and generates engine sounds through mechanical means.

U.S. Pat. No. 5,173,072 to Ozawa discloses a toy vehicle that vibrates and then rolls forward. The toy uses a complex mechanical mechanism comprising a large number of parts to switch the toy from the vibrating mode to the rolling mode.

U.S. Pat. No. 5,074,820 to Nukayama discloses a stuffed toy that vibrates and generates various sounds. Each sound and vibration is separately and manually controlled by the user through switches hidden in various parts of the stuffed toy.

Other toys are available in the market that generate sound alone or in combination with flashing lights. However, a need exists to provide a toy vehicle that vibrates while simultaneously generating sounds, flashing lights or propelling itself. Preferably still, these sequences of events should be electronically controlled by the toy. The present invention satisfies this need.

BRIEF DESCRIPTION OF THE INVENTION

This invention relates generally to vibrating children's toys and more specifically, to a toy car that simulates a true car by generating vibrations through an internal electromechanical vibration generator. In one preferred embodiment the invention simulates a stock racing car. When a switch is closed an electric circuit activates the vibration generator to open and a sound source causing the toy to simulate the sound and motions of a stock racing car "revving up." After a preset time elapses, the electric circuit shuts off the vibration generator and activates a propulsion mechanism causing the toy to roll forward. At the same time the electric circuit causes the sound source to generate high speed engine sounds. The electric circuit may also be used to synthesize typical automobile sounds (e.g., tires squealing, brakes screeching, and other "hot rod" sounds) or to activate lights (e.g. head lights, tail lights and/or either vehicle lights). The sounds and lights may be synchronized with the vibratory motion to simulate real cars or they may provide other sounds and lighting effects that will increase the appeal of the toy (e.g. crashing sounds, racing music or strobe lights).

In one preferred embodiment the wheels of the toy car move freely so that the car may be pushed or rolled while it is vibrating. In another preferred embodiment the car will propel itself in the forward or reverse direction, through the use of an additional electric motor to drive one or more wheels. Such propulsion may be timed through the electric circuit to occur simultaneously with, before or after the vibration, and in coordination with the other special effects.

In another preferred embodiment, the timing of the effects can be controlled by the electrical circuit in response to external events (e.g. crash sound if the toy impacts another object, sound of gasoline pouring where gas can is inserted), through the placement of switches or sensors in various places in the toy.

Other embodiments of the present invention are also possible. Examples of such alternatives are a board game that vibrates and generates special effects in response to the players movement of pieces or a building that shakes and makes earthquake sounds.

Accordingly, it is a general object of the present invention to provide an improved child's toy.

It is a more particular object of the present invention to provide a toy car that vibrates to simulate a true car, with said vibrations being produced by an internal eccentrically weighted motor.

Another object of the invention is to provide a toy car that generates other effects such as sound, lights and propulsion synchronized with the vibration of the toy to either increase the realism of the toy or generally entertain children.

Another object of the invention is to provide a toy that is rugged and durable.

Another object of the invention is to provide a toy that is comparably easy and inexpensive to mass produce.

Finally, it is another object of this invention to provide a toy wherein the toy body provides for a complete enclosure and protection of the electronic and electro-mechanical devices so as to prevent damage to the user, in particular, to small children.

BRIEF DESCRIPTION OF THE SEVERAL VIEWS OF THE DRAWINGS

FIG. 5 is a sample timing sequence for controlling a toy car with effects.

DETAILED DESCRIPTION OF THE INVENTION

Figure 1:
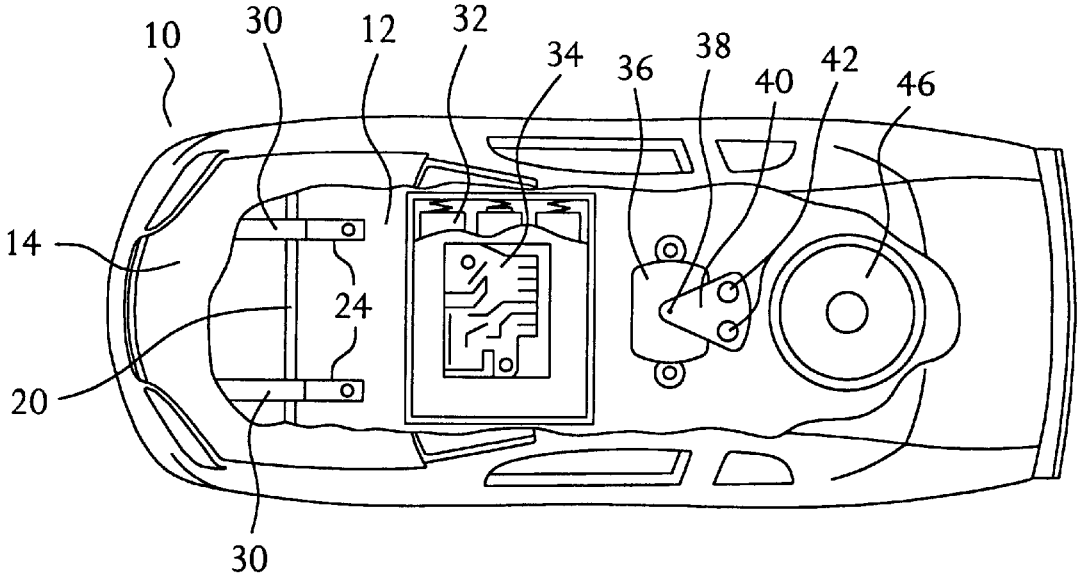
FIG. 1 is a top plan exploded view of the toy car of the present invention.
Figure 2:
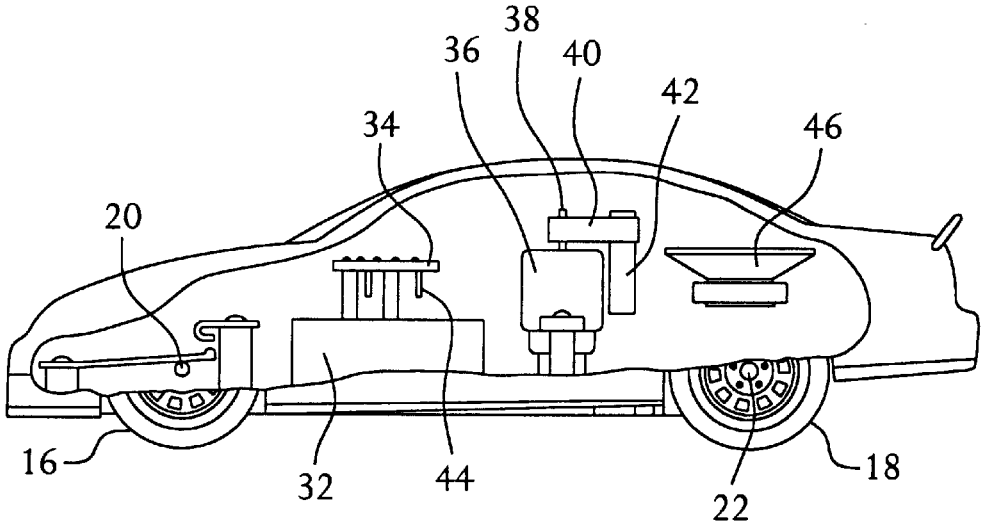
FIG. 2 is a side cross-section view of FIG. 1.
Figure 3:
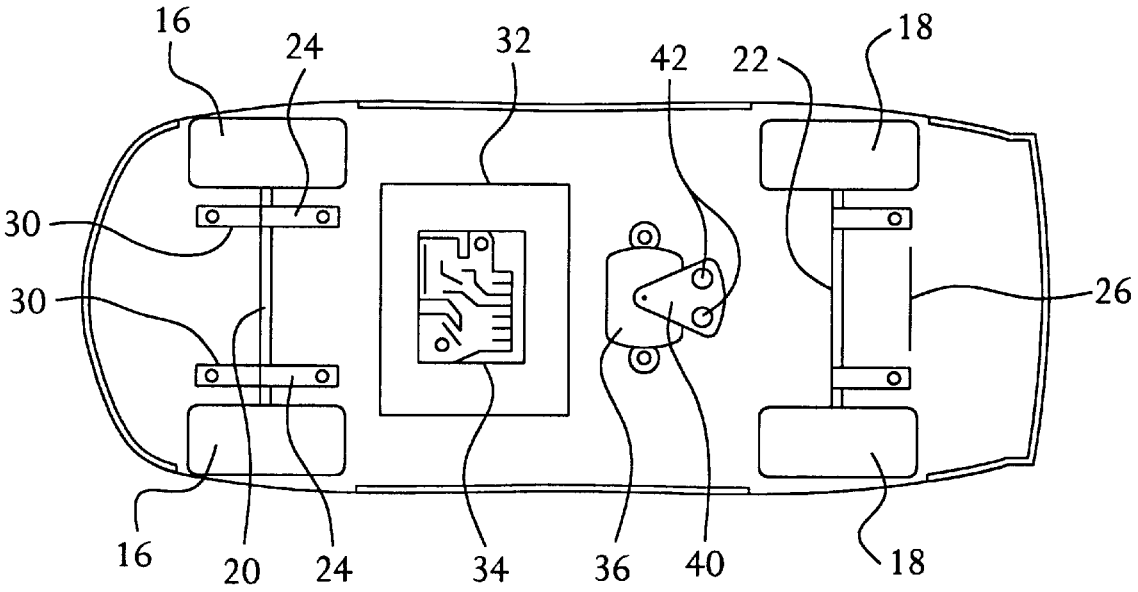
FIG. 3 is a detailed phantom view of the chassis of the car of the present invention.
Figure 7:
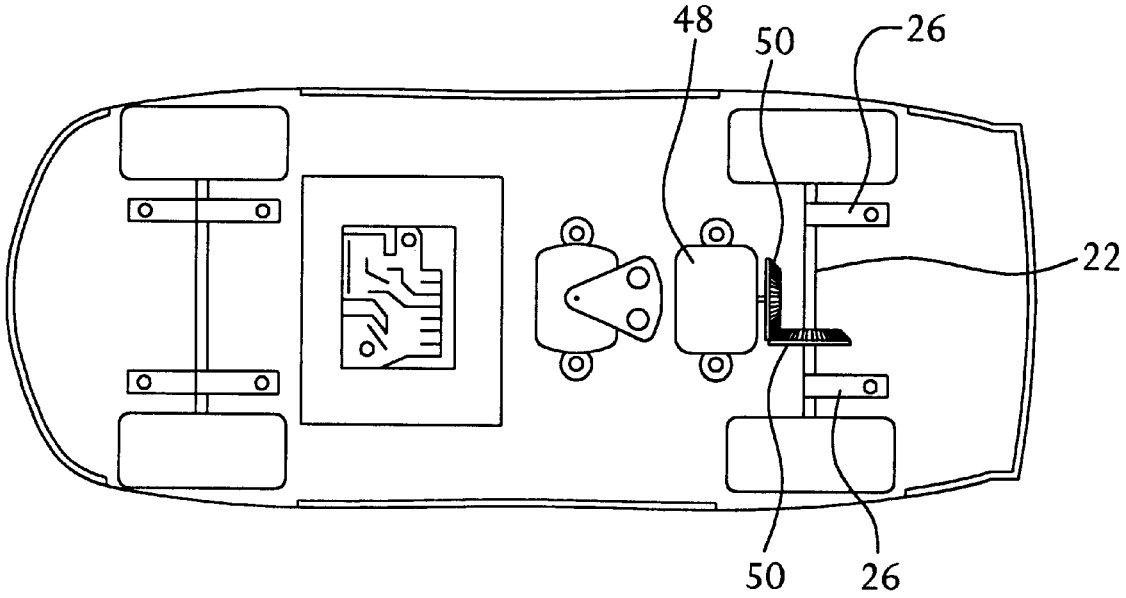
FIG. 7 is an alternate embodiment of the present invention with a second electric motor connected to wheels forming a propulsion mechanism.

As illustrated generally by FIGS. 1 through 3, the toy vehicle 10 comprises a chassis 12 to which a car body 14 is mounted. Preferably, chassis 12 and car body 14 are fabricated of light weight plastic such as ABS or other similar flexible semi-rigid materials which may be inexpensively and easily molded by conventional fabrication techniques. The vehicle 10 further includes a pair of front wheels 16 and a pair of rear wheels 18 mounted to chassis 12 via a front axle 20 and rear axle 22 connected to the chassis 12 through axle mounts, which in the present invention are merely slots in the chassis. In the preferred embodiment, shown in FIG. 7, the vehicle has its own propulsion mechanism, such as an electric motor 48 connected to the vehicle's rear wheels 18 (propulsion device) through a set of gears 50 and the rear wheel axles 22. In one embodiment, axles 20, 22 and wheels 16,18 rotate freely within axle mounts on chassis 12. Additional support is provided to the axles 20,22 by front shock absorbers 24 and rear shock absorbers 26. In an alternative embodiment, improved vibrations may be achieved by mounting the axles 20, 22 to the chassis through spring type shock absorbers or other mechanical damping mechanism known to those skilled in the art. Spring isolation also increases the vertical vibration of the toy and will dampen the lateral vibration, thus increasing the toy's realism.

Depending on the type of toy vehicle and the medium upon which it rests, the propulsion device could be continuous track (e.g. toy bull dozer), propeller (e.g. toy airplane) or paddle (e.g. toy boat).

In one embodiment, the front shock absorbers 24 also act as an electro-mechanical switch. When the front of the toy car is depressed the front shock absorbers 24 momentarily come into contact with metal plates 30 that are connected by electric wires to a electric power supply 32 and electric circuit 34 mounted in the chassis 12. The momentary closure of the switch 24, 30 activates the electric circuit 34 which then controls the toy through one or more programmed sequences of events.

Figure 6:
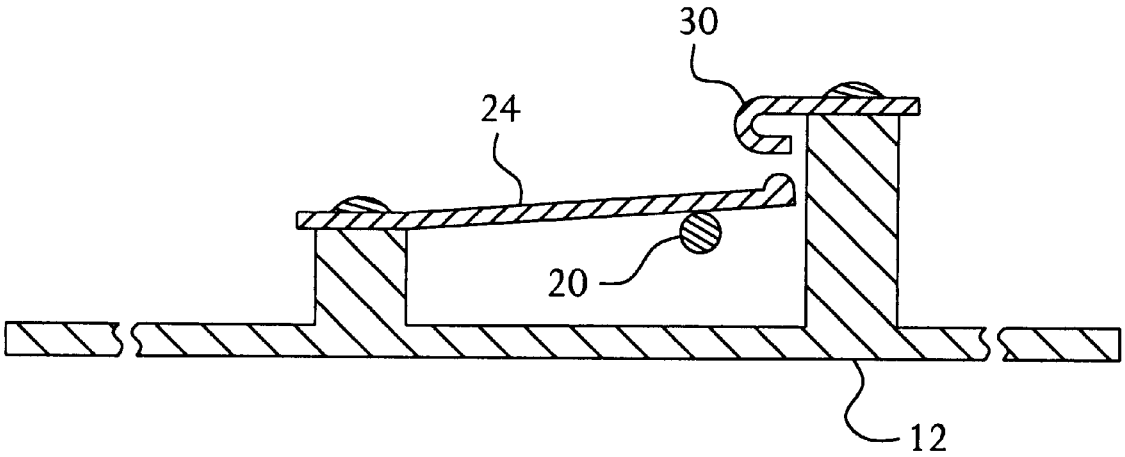
FIG. 6 is a detailed view of one switching mechanism useful in the present invention.

FIG. 6 demonstrates how the metal front shock absorbers 24, front axle 20 and metal contact plates 30 act as a switch. When the body of the vehicle 14 is pressed down it causes the chassis 12 to lower along with the front shock absorbers 24 and the contact plates 30. However, the front axle 20 does not move because its height is fixed by the radius of the front wheels 16. As the front shock absorber 24 and the contact plates 30 lower, the front shock absorbers 24 are pressed by the front axle 20 against the contact plates 30, thus closing the switch. As soon as the vehicle body 14 is released the front shock absorbers 24 and the contact plates 30 lift and separate and the circuit is opened. In an alternative embodiment, the switch is activated by the insertion or removal of a gasoline nozzle. It will be obvious to those skilled in the art that other switch mechanisms, including push buttons, motion detectors, remote controls, or touch sensors could be used to accomplish the same task.

While on, the electric circuit 34 connects the power supply 32 to an electro-mechanical vibration generator mounted either to the chassis 12 or the toy body 14, causing the car 10 to vibrate. In this present invention the vibration generator is an electric motor 36 with the shaft 38 of the motor 36 connected to the narrow end of a plastic wedge shaped rigid arm 40 that has two relatively heavy weights 42 attached on the wide end farthest from the motor shaft 38. With the motor 36 running, the weights 42 spin around the shaft 38 generating angular momentum. The angular momentum generated by the spinning masses 42 is transferred through the arm 40, shaft 38 and motor 36 to the chassis 12 which vibrates relative to the axles 20, 22 and wheels 16, 18. In the present invention the motor 36 is mounted so that its shaft 38 is perpendicular to the plane encompassing the bottom of the chassis 12, thus causing the motor 36 to spin in a plane that is parallel with the plane of the chassis 12. However, the motor 36 could be mounted in other orientations in order to achieve different types of vibrations. While the present mechanism for causing vibrations is particularly rugged and cost efficient, many other types of electro-mechanical devices can be used to generate vibrations such as rockers or pistons.

At the same time as the motor 36 is running, the electric circuit 34 provides power to a sound source, an electric speaker 46, mounted to the car body 14 or chassis 12. Together, the electric circuit 34 and speaker 46 generate a loud sound that simulates the sound of a race car accelerating its engine while its transmission is in the neutral position (i.e. "revving" its engine).

Figure 4:
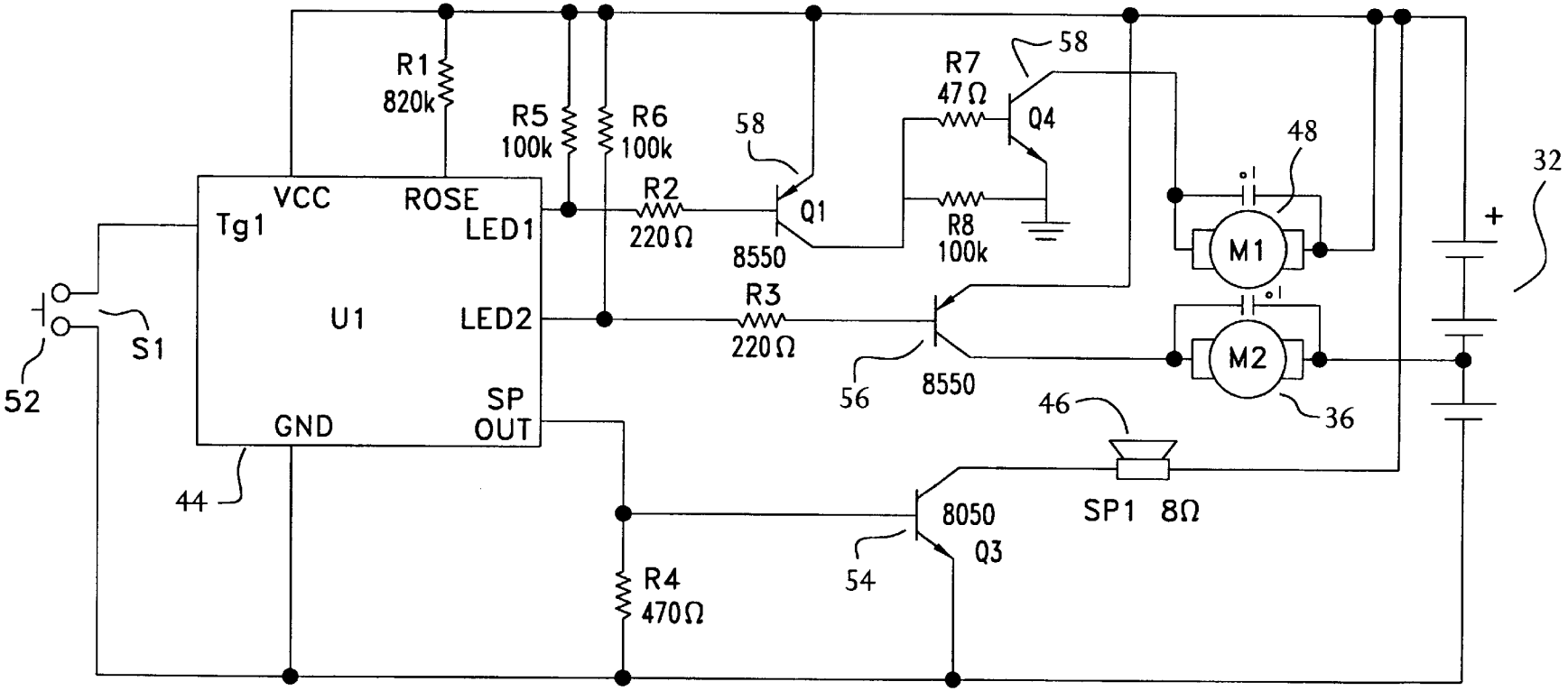
FIG. 4 is a schematic of an example of electrical circuit useful in the present invention.

FIG. 4 describes and electric circuit 34 of the type that can be used to accomplish the invention. The circuit is capable of operating a vibrating toy car, shown in FIG. 7, with sound and propulsion. The switching mechanism 52 is an internal push button that is depressed by inserting a toy gas can nozzle into the toy car's gas tank. This begins a timed sequence programmed into the integrated circuit 44 as shown in FIG. 5. The integrated circuit 44 is a programmable device capable of controlling timed events and generating analog signals to produce sound. During the initial sequence the car generates the sounds of a race car fueling. The sound signal is stored and synthesized by the integrated circuit 44 and amplified through a transistor 54 using electrical power supplied from the power supply 32, in this embodiment, consisting of three batteries. The amplified sound signal drives a speaker 46 which converts the electrical signal into an audible signal. When the toy gas can nozzle is removed, the switch 52 is released and a new sequence of events begins. The integrated circuit generates an "on" signal for the vibration motor 36. This signal turns the vibration motor drive transistor 56 on, which in turn allows current from the power supply 32 to flow through the vibration motor 36 causing it to spin. While the vibration motor 36 is spinning, the integrated circuit 44 generates a series of sounds consisting of engine ignition sound followed by idling sounds. At this point, the integrated circuit 44 turns of the vibration motor 36 and at the same time generates a "peel out" sound. When the "peel out" sound ends the integrated circuit 44 generates an "on" signal for the propulsion motor 48. This is accomplished in a similar method to the vibration motor, except that due to the higher electrical current requirements, a two staged set of transistors 58 is used to amplify the on signal from the integrated circuit and drive the propulsion. The propulsion motor 48 turns the rear wheels 18 through a set of gears 50 causing the entire toy car 10 to roll forward. The integrated circuit 44 continues to control the toy through a similar series of vibration, sound, and propulsion as further described in FIG. 5.

The toy vehicle disclosed has a plurality of sequences of events each consisting of two or more effects: ignition, peel out, racing, driving and braking. It will be obvious to those skilled in the art that the integrated circuit 44 can be programmed to accomplish, with the disclosed or similar circuitry, any desired sequence of events. These special effects may include any desired sounds, lights and propulsion (forward, reverse, circular, zig-zag), and vibration, in any sequence, serially or in combination.

In an alternative embodiment the electric circuit 34 also controls a set of lights mounted on the outside of the car body 14 causing the lights to turn on, or to flash on and off, in synchronization with the sound, propulsion and vibrations. The circuitry for a lighting circuit would be similar to the disclosed circuitry and is obvious to those skilled in the art.

Figure 8:
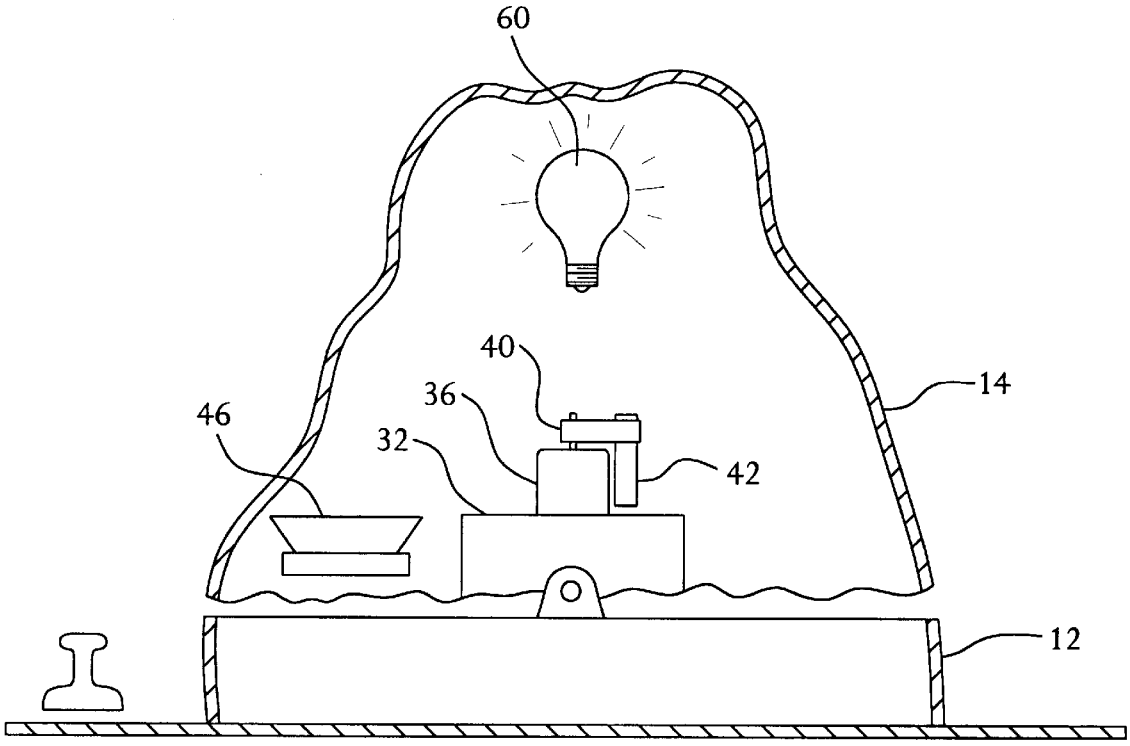
FIG. 8 is an alternate embodiment of the invention in the form of a board game with a vibrating volcano at its center, where the volcano simulates eruption through vibration, sound and light.

While the preferred embodiments described herein are toys that simulate race cars, it is understood that the same techniques may be employed to simulate other vehicles such as boats, airplanes, tanks, sports cars or ambulances. Indeed, the invention may be applied to toys other than vehicles where it is desirable to have an internally generated vibratory motion. One example of such a toy is a board game built around a volcano that vibrates while generating sound and light to simulate an eruption as shown in FIG. 8, which shows the toy including a vibration generator 36, 40, 42, sound source 46 and light source 60. As shown in the FIG. 8, what was the chassis in the toy vehicle can be any platform 12, and similarly the body 14 can take any shape, such as a mountain or a building. Reference is made to the foregoing disclosure of a toy vehicle with respect to the operation of such a board game.

It is understood that the invention is not limited to the disclosed embodiments, but on the contrary, is intended to cover various modifications and equivalent arrangements included within the spirit and scope of the appended claims. Without further elaboration, the foregoing will so fully illustrate the invention, that others may by current or future knowledge, readily adapt the same for use under the various conditions of service.

We claim:

1. A toy vehicle comprising:

a chassis;

a body mounted to the chassis;

an electro-mechanical vibration generator operatively connected with the chassis;

a light source operatively connected with the body;

an electrical circuit connected with the vibration generator and light source wherein the electrical circuit controls the sequence and timing of the vibration generator and the light source to provide at least one sequence of events;

an electrical power source connected with the vibration generator, light source and electrical circuit; and a switch connected with the electrical circuit wherein upon activation of the switch the electrical circuit initiates the at least one sequence of events.

2. A toy vehicle as recited in claim 1 wherein the light source is selected from the group consisting of incandescent light bulbs and light emitting diodes.

3. A toy vehicle as recited in claim 1 wherein the vibration generator comprises an electric motor with the shaft of said motor connected to an eccentrically mounted weight such that the weight moves in a circle about a center of rotation.

4. A toy vehicle as recited in claim 1 further comprising a first sequence of events and a second sequence of events.

5. A toy vehicle comprising:

a chassis;

a body mounted to the chassis;

an electro-mechanical vibration generator operatively connected with the chassis;

a sound source operatively connected with the chassis;

an electrical circuit connected with the vibration generator and sound source wherein the electrical circuit controls the sequence and timing of the vibration generator and the sound source to provide at least one sequence of events;

a electrical power source connected with the vibration generator, sound source and electrical circuit; and a switch connected with the electrical circuit wherein upon activation of the switch the electrical circuit initiates the at least one sequence of events.

6. A toy vehicle as recited in claim 5 wherein the sound source comprises an electric speaker.

7. A toy vehicle as recited in claim 6 wherein the electric speaker receives an input signal from the electrical circuit that is synthesized by an integrated circuit.

8. A toy vehicle as recited in claim 5 wherein the vibration generator comprises an electric motor with the shaft of said motor connected to an eccentrically mounted weight such that the weight moves in a circle about a center of rotation.

9. A toy vehicle as recited in claim 1 further comprising a first sequence of events and a second sequence of events.

10. A toy vehicle comprising:

a chassis;

a body mounted to the chassis;

an electro-mechanical vibration generator operatively connected with the chassis;

an propulsion mechanism connected with the chassis wherein the operation of the propulsion mechanism causes the toy vehicle to move across the medium on which it rests;

an electrical circuit connected with the vibration generator and propulsion mechanism wherein the electrical circuit controls the sequence and timing of the vibration generator and the propulsion mechanism to provide at least one sequence of events;

an electrical power source connected with the vibration generator, propulsion mechanism and electrical circuit; and a switch connected with the electrical circuit wherein upon activation of the switch the electrical circuit initiates the at least one sequence of events.

11. A toy vehicle as recited in claim 10 wherein the propulsion mechanism comprises an electric motor connected with a propulsion device selected from the group consisting of wheels, paddles, continuous track and propellers.

12. A toy vehicle as recited in claim 10 wherein the vibration generator comprises an electric motor with the shaft of said motor connected to an eccentrically mounted weight such that the weight moves in a circle about a center of rotation.

13. A toy vehicle as recited in claim 10 further comprising a first sequence of events and a second sequence of events.

14. A child's toy comprising a toy vehicle including:

a platform;

a body mounted to the platform;

effect generators for generating a first effect, a second effect and a third effect, wherein at least one effect is vibration and the remaining effects are selected from the group consisting of vibration, sound, light and propulsion of the vehicle;

an electrical circuit connected with the effect generators wherein the electrical circuit controls the sequence and timing of the effects;

an electrical power source connected with the vibration generator, propulsion mechanism and electrical circuit; and a switch connected with the electrical circuit wherein upon activation of the switch the electrical circuit initiates a sequence of said effects.

15. A member for a board game comprising:

a platform;

a body mounted to the platform;

an electro-mechanical vibration generator operatively connected with the platform;

a light source operatively connected with the body;

an electrical circuit connected with the vibration generator and light source wherein the electrical circuit controls the sequence and timing of the vibration generator and the light source to provide at least one sequence of events;

an electrical power source connected with the vibration generator, light source and electrical circuit; and a switch connected with the electrical circuit wherein upon activation of the switch the electrical circuit initiates the at least one sequence of events.

16. A member for a board game as recited in claim 15 wherein the light source is selected from the group consisting of incandescent light bulbs and light emitting diodes.

17. A member for a board game as recited in claim 15 wherein the vibration generator comprises an electric motor with the shaft of said motor connected to an eccentrically mounted weight such that the weight moves in a circle about a center of rotation.

18. A member for a board game as recited in claim 15 further comprising a first sequence of events and a second sequence of events.

19. A member for a board game comprising:

a platform;

a body mounted to the platform;

an electro-mechanical vibration generator operatively connected with the platform;

a sound source operatively connected with the body;

an electrical circuit connected with the vibration generator and sound source wherein the electrical circuit controls the sequence and timing of the vibration generator and the sound source to provide at least one sequence of events;

a electrical power source connected with the vibration generator, sound source and electrical circuit; and a switch connected with the electrical circuit wherein upon activation of the switch the electrical circuit initiates the at least one sequence of events.

20. A member for a board game as recited in claim 19 wherein the sound source comprises an electric speaker.

21. A member for a board game as recited in claim 20 wherein the electric speaker receives an input signal from the electrical circuit that is synthesized by an integrated circuit.

22. A member for a board game as recited in claim 19 wherein the vibration generator comprises an electric motor with the shaft of said motor connected to an eccentrically mounted weight such that the weight moves in a circle about a center of rotation.

23. A member for a board game as recited in claim 19 further comprising a first sequence of events and a second sequence of events.

24. A member for a board game comprising:

a platform;

a body mounted to the platform;

effect generators, operatively mounted to the platform, for generating a first effect, a second effect and a third effect, wherein at least one effect is vibration and the remaining effects are selected from the group consisting of vibration, sound, and light;

an electrical circuit connected with the effect generators wherein the electrical circuit controls the sequence and timing of the effects;

an electrical power source connected with the vibration generator, propulsion mechanism and electrical circuit; and a switch connected with the electrical circuit wherein upon activation of the switch the electrical circuit initiates a sequence of said effects.

* * * * *